US009476600B2

(12) United States Patent
Tran et al.

(10) Patent No.: US 9,476,600 B2
(45) Date of Patent: Oct. 25, 2016

(54) FAN MOTOR CONTROLLER FOR USE IN AN AIR CONDITIONING SYSTEM

(75) Inventors: John Tran, The Colony, TX (US); Mark Olsen, Carrollton, TX (US); Jeff Mangum, Argyle, TX (US)

(73) Assignee: Lennox Industries Inc., Richardson, TX (US)

( * ) Notice: Subject to any disclaimer, the term of this patent is extended or adjusted under 35 U.S.C. 154(b) by 1114 days.

(21) Appl. No.: 12/901,766

(22) Filed: Oct. 11, 2010

(65) Prior Publication Data

US 2012/0085113 A1 Apr. 12, 2012

(51) Int. Cl.

| | |
|---|---|
| ***F25B 47/00*** | (2006.01) |
| ***F24F 1/38*** | (2011.01) |
| ***F24F 1/20*** | (2011.01) |
| ***F25B 13/00*** | (2006.01) |

(52) U.S. Cl.

CPC . *F24F 1/38* (2013.01); *F24F 1/20* (2013.01); *F25B 13/00* (2013.01); *F25B 47/006* (2013.01); *F25B 2313/0294* (2013.01); *F25B 2313/02741* (2013.01); *F25B 2600/01* (2013.01); *F25B 2700/2106* (2013.01); *Y10T 29/49359* (2015.01)

(58) Field of Classification Search

CPC ..... F24F 1/38; F24F 1/20; F25B 13/00; F25B 47/006; F25B 2313/02741; F25B 2313/0294; F25B 2700/2106

USPC ..... 62/80, 81, 151, 155, 156, 158, 160, 62/180, 186, 507

See application file for complete search history.

(56) References Cited

U.S. PATENT DOCUMENTS

| | | | | |
|---|---|---|---|---|
| 4,619,114 | A * | 10/1986 | Wilson | 62/180 |
| 5,528,908 | A * | 6/1996 | Bahel et al. | 62/81 |
| 5,529,908 | A * | 6/1996 | Palva | C12N 15/75 435/134 |
| 7,266,956 | B2 * | 9/2007 | Norrell | F24F 1/18 62/125 |
| 2003/0074908 | A1 * | 4/2003 | Baker | F25B 49/027 62/183 |
| 2010/0070086 | A1 * | 3/2010 | Harrod et al. | 700/276 |
| 2015/0114014 | A1 * | 4/2015 | Choi | F24F 1/06 62/89 |
| 2015/0330644 | A1 * | 11/2015 | Jeung | F24F 11/0076 62/186 |

FOREIGN PATENT DOCUMENTS

| | | | | |
|---|---|---|---|---|
| JP | 06026697 A | * | 2/1994 | F24F 11/02 |
| JP | 07043051 A | * | 2/1995 | F25B 47/02 |

* cited by examiner

*Primary Examiner* — M. Alexandra Elve
*Assistant Examiner* — Alexis Cox
(74) *Attorney, Agent, or Firm* — Baker Botts L.L.P.

(57) ABSTRACT

An air conditioning system includes an exterior housing, and a motor having fan blades rotatably coupled thereto located within the exterior housing. The air conditioning system further includes a controller coupled to the motor and configured to, based upon climate conditions proximate the exterior housing, alternate between an ON cycle during which the fan blades are rotated and an OFF cycle during which the fan blades are not rotated.

18 Claims, 4 Drawing Sheets

FAN MOTOR CONTROLLER FOR USE IN AN AIR CONDITIONING SYSTEM

TECHNICAL FIELD

This application is directed, in general, to an air conditioning system, and more specifically, to a fan motor controller for use in an air conditioning system.

BACKGROUND

Air conditioning systems that reside outside a commercial building or residence, such as refrigeration units and heat pumps, are well known. In some applications, these outside units must operate in both warm and cold climate conditions. One such example is a heat pump, wherein the heat pump may be reversibly operated to heat or to cool a climate-controlled space, depending on the climate conditions outside.

Under certain cold climate conditions, ice may form between the fan blades and a housing component thereof, thereby preventing the fan blade from turning when an "on command" is received. Alternatively, under certain cold climate conditions the weight of snow build up on the fan blades may be sufficient to prevent the fan blades from turning when the "on command" is received. Each of these scenarios is undesirable, as it may potentially cause fan distortion or motor damage due to the overload on the system.

What is needed is an air conditioning system that addresses the problems associated with operating in cold climate conditions.

SUMMARY

One aspect provides an air conditioning system. The air conditioning system, in this embodiment, includes an exterior housing, and a motor having fan blades rotatably coupled thereto located within the exterior housing. The air conditioning system, in this embodiment, further includes a controller coupled to the motor and configured to rotate the fan blades based upon climate conditions proximate the exterior housing.

Another aspect provides a method of manufacturing an air conditioning system. This method, in one embodiment, includes: 1) providing an exterior housing, 2) placing a motor having fan blades rotatably coupled thereto within the exterior housing, and 3) coupling a controller to the motor, the controller configured to rotate the fan blades based upon climate conditions proximate the exterior housing.

Also provided is an alternative air conditioning system. This alternative air conditioning system, in one example, includes an exterior housing, as well as a compressor having coils fluidly coupled thereto located within the exterior housing. The alternative air conditioning system further includes a motor having fan blades rotatably coupled thereto located within the housing, the motor and fan blades configured to operate independent of the compressor.

BRIEF DESCRIPTION

Reference is now made to the following descriptions taken in conjunction with the accompanying drawings, in which.

DETAILED DESCRIPTION

This disclosure recognizes that ice and snow blocking the movement of the fan blades of an air conditioning system may be freed, and/or prevented, by routinely signaling the fan motor to rotate the fan blades when the climate surrounding the air conditioning unit meets certain predetermined parameters. For instance, the instant disclosure recognizes that by cycling the fan motor on and off while the temperature surrounding the air condition unit is below freezing, the likelihood of the fan blades freezing up because of ice, or being substantially weighted down because of snow, is greatly diminished.

As used herein "air conditioning system" is meant to have a broad meaning that covers a myriad of apparatus, such as heat pump units and refrigeration units that can be used for refrigeration purposes for cooling the inside of a targeted structure, such as a residence or commercial buildings or refrigeration units for perishable items. The following abbreviations are defined as indicated below in this description:

ID: Indoor
OD: Outdoor
HX: Heat Exchanger
OAT: Outside Air Temperature
MRT: Minimum Reset Temperature
COT: Compressor Off Timer
FOT: Fan On Timer
HVAC: Heating-Ventilating and Air Conditioning The following discussion describes various embodiments in the context of heating an indoor ambient, such as a residential living area. Such applications are often referred to in the art as HVAC. Heat is described in various embodiments as being extracted from an outdoor ambient. Such references do not limit the scope of the disclosure to use in HVAC applications, nor to residential applications. As will be evident to those skilled in the pertinent art, the principles disclosed may be applied in other contexts with beneficial results, including without limitation mobile and fixed refrigeration applications. For clarity, embodiments in the following discussion may refer to heating a residential living space without loss of generality to other applications as mentioned above.

Figure 1:
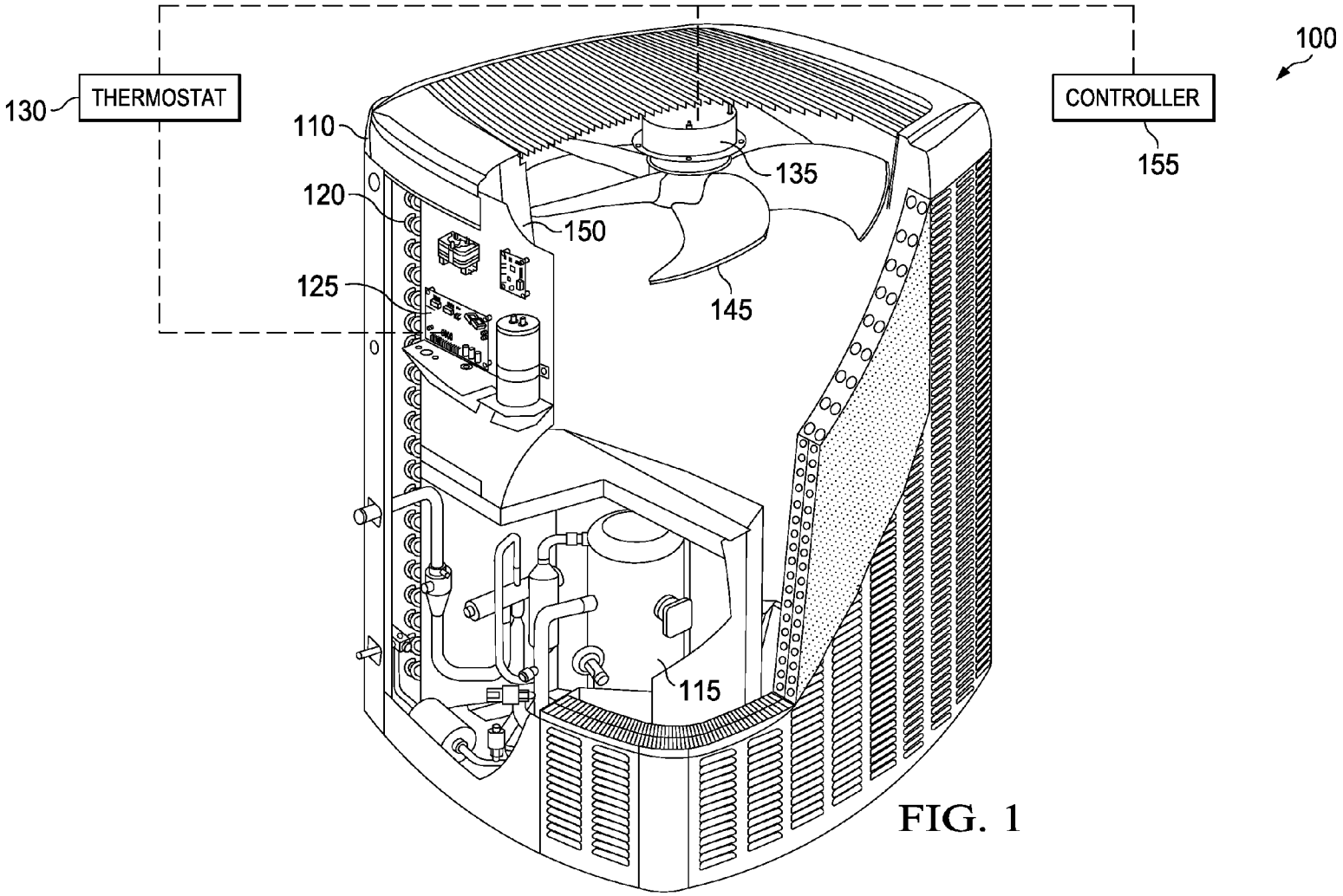
FIG. 1 illustrates an embodiment of an air conditioning unit which may be operated in accordance with the embodiments of this disclosure.

FIG. 1 illustrates a partial cut away view of one embodiment in which the present disclosure may be employed, which in this case, is a heat pump 100. It should be understood that the heat pump 100 is presented only as one configuration, and that other air conditioning systems, such as refrigeration units for both residential and commercial use are also applicable. In the illustrated embodiment, the heat pump 100 includes an exterior housing 110. Located within the exterior housing 110 is a compressor 115 and associated coils 120 that are fluidly connected with each other and contain the appropriate refrigeration fluid. The heat pump 100 may also include control circuitry 125 that is coupled to a remote controller 130, such as a conventional thermostat located on the interior of the structure (not shown). The controller 130 may be coupled to the circuitry 125 by electrical wires, or it may be wirelessly connected to the circuitry 125. In such cases the controller 130 and circuitry 125 will have an appropriate transmitter/receiver configuration.

The heat pump unit 100 also includes a motor 135. In one embodiment, the motor 135 may be a variable speed motor, such as a standard split capacitor motor. In another embodiment, however, the motor 135 could be an electronic commutated motor (ECM). Though a split capacitor motor and an ECM motor are specifically mentioned herein, it should be understood that other types of motors are also within the scope of this disclosure.

Attached to the motor 135 are fan blades 145 that are shaped to move air through the heat pump unit 100. In the illustrated embodiment, the housing 110 may also include an orifice ring 150 that is positioned adjacent and about the fan blades 145. The clearance between the fan blades 145 and the orifice ring 150 is relatively small, and as such, ice or snow can easily build up between the two, and thereby prevent movement of the fan blades 145 when the compressor 115 and motor 135 receive an "on command."

To address this problem, this disclosure provides a controller 155 that is programmed to send a signal to the motor 135 to rotate the fan blades 145 based upon climate conditions proximate the exterior housing 110. It should be noted that the phrase "climate conditions proximate the exterior housing" means the temperature, pressure, humidity, etc. of the air in and around the housing 110, as opposed to the climate conditions of the structure (e.g., home, business, interior of a refrigeration unit, etc.) being conditioned. Additionally, the climate conditions need not be those within the housing 110 itself, or even within a few feet surrounding the housing 110, but can be the climate conditions in the general location (e.g., city, zip code, etc.) that the heat pump 100 is located. In one example, the controller 155 uses internal sensors located within the heat pump 100 to measure the climate conditions. In yet another embodiment, the controller 155 uses climate conditions obtained from an internet source, based upon the general (or even GPS) location of the heat pump 100.

The controller 155 may embody a number of different configurations and locations and remain within the purview of this disclosure. In one embodiment, the controller 155 may be a part of the main circuitry 125. In another embodiment, the controller 155 might be in communication with the main circuitry 125, but be part of the motor 135. In yet another embodiment, the controller 155 might be a part of the circuitry of controller 130 located in the structure. In yet another embodiment, the controller 155 might be separate from the circuitry 125, motor 135, and controller 130, and either be located else where in the heat pump 100 or even distally therefrom. In such instances, the controller 155 may be coupled to the motor 135, the controller 130, or circuitry 125 either by wires, a wireless system (either of which are shown generally by the dashed line) or an optical system, in which case, the motor 135, the controller 155 or the circuitry 125 will both include sufficiently configured conventional transmitters/receivers for wireless or optical communication.

Figure 2:
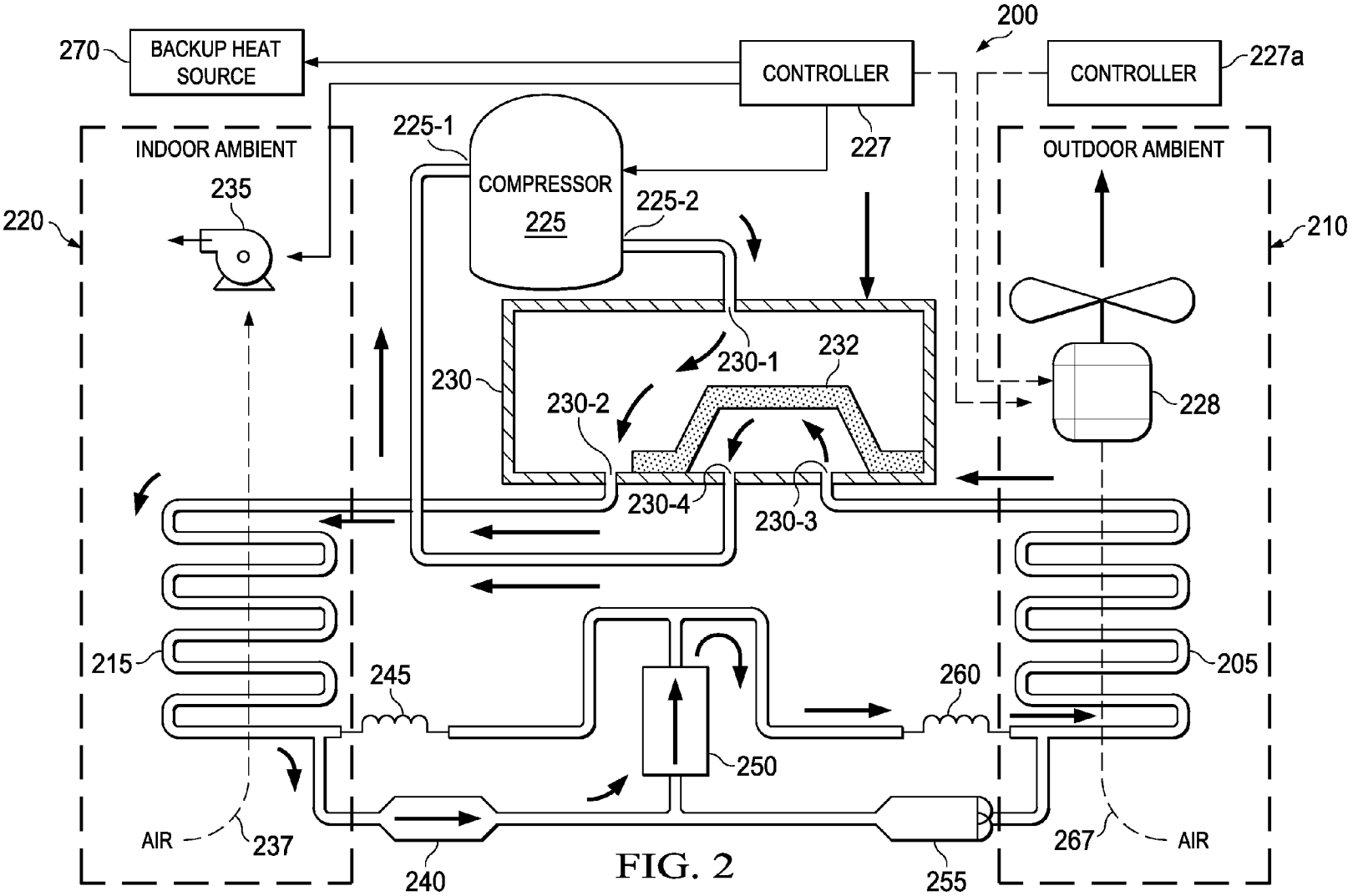
FIG. 2 illustrates a block diagram of a heat pump system of the disclosure operating to transport heat from an outdoor ambient to an indoor ambient and which may be operated in accordance with the embodiments of this disclosure.

FIG. 2 is a block diagram of a heat pump system 200, which is but one air conditioning system in which the controller 155 may be employed. The system 200 may be used in, e.g., residential/commercial HVAC, retail grocery refrigerators (such as those used in grocery stores), refrigerated warehouses, domestic refrigeration and refrigerated transport. The system 200 includes an outdoor (OD) HX coil 205 in an OD ambient 210, and an indoor (ID) HX coil 215 in an ID ambient 220. In the heating mode the OD HX coil 205 acts as an evaporating coil that extracts heat from the OD ambient 210, and the ID HX coil 215 acts as a condensing coil that releases heat to the ID ambient 220. In cooling mode, the roles of the HX coils 205, 215 are reversed.

The system 200 as illustrated is configured to operate in a "pumped heating mode," e.g. to transport heat from the OD HX coil 205 to the ID HX coil 215. Conceptually, in this mode the OD ambient 210 may be viewed as a heat source, and the ID ambient 220 may be viewed as a heat sink. When the system 200 is configured to operate in a "cooling mode," e.g. to transport heat from the ID HX coil 215 to the OD HX coil 205, the ID ambient 220 is the heat source and the OD ambient 210 is the heat sink.

The operation of the system 200 in the configuration of FIG. 2 is now described in the context of the pumped heating mode without limitation to a particular application thereof. A compressor 225 includes an input port 225-1 and an output port 225-2. The compressor 225 and the HX coils 205, 215 form a closed system that includes a refrigerant. The compressor 225 pressurizes the refrigerant, which then flows to a flow valve 230. In the illustrated embodiment, a controller 227 is configured to generally control the operation of the components of the system 200, including provide an "on command" to a fan blade motor 228 and the compressor 225 when there is a need to provide heat to increase the temperature of the ID ambient 220. However, as explained above with respect to other embodiments, a separate controller 227*a*, or one integral to the motor 228, may be included within the design to control the motor 228 in the event that the rotation of the fan blades is needed based upon the climate conditions proximate the exterior housing. The controller 227 may include any combination of electronic, mechanical and electro-mechanical components configured to control the components of the system 200 within the scope of the disclosure, as those mentioned above and further includes microprocessors, microcontrollers, state machines, relays, transistors, power amplifiers and passive electronic devices.

The flow valve 230 is illustrated without limitation as a reversing slide valve. The following description is presented without limitation for the case that the flow valve 230 is a reversing slide valve. While a reversing slide valve may be beneficially used in various embodiments of the disclosure, those of ordinary skill in the pertinent art will appreciate that similar benefit may be obtained by alternate embodiments. Embodiments discussed below expand on this point.

The flow valve 230, consistent with the construction of reversing slide valves, has a sliding portion 232. In an example embodiment, without limitation, the flow valve 230 is a Ranco type V2 valve available from Invensys Controls, Carol Stream, Ill., USA. The flow valve 130 includes four ports 230-1, 230-2, 230-3, and 230-4. The sliding portion 232 is typically located in one of two positions. In a first position, as illustrated in FIG. 2, the ports 232-1 and 232-2 are connected, as are the ports 232-3 and 232-4. In the second position, the ports 232-2 and 232-4 are connected, as are the ports 232-1 and 232-3.

When the compressor 225 receives an "on command", refrigerant flows from the compressor 225 to the ID HX coil 215 via the ports 230-1, 230-2. The refrigerant carries an enthalpy $\Delta H_v$ due to compression, and an enthalpy due to condensation related to the phase change of the refrigerant from gas to liquid. The refrigerant is therefore typically warmer than the ID ambient 220. A blower 235 controlled by the controller 227 moves air 237 over the ID HX coil 215, transferring heat from the refrigerant to the ID ambient 220, thus reducing the temperature of the refrigerant.

The refrigerant flows through a check valve 240 oriented to open in the illustrated direction of flow, causing the refrigerant to bypass a throttle 245. The refrigerant then flows through a filter/drier 250. A check valve 255 is oriented to close in the direction of flow, thus causing the refrigerant to flow through a throttle 260. A portion of the refrigerant vaporizes on the downstream, low pressure side of the throttle 260, thereby cooling according to $\Delta H_v$ and expansion. The cooling of the refrigerant causes the OD HX coil 205 to cool. The motor 228, which may also be controlled by the controller 227 moves air 267 over the OD HX coil 205, transferring heat from the OD ambient 210 to the refrigerant, unless the fan blades are restricted by ice and/or snow. To prevent this ice and/or snow buildup, a logic program, as described below, associated with controller 227 or 227*a* will be engaged to rotate the fan blades based upon climate conditions proximate the exterior housing. The refrigerant returns to the compressor 225 via the ports 230-3, 230-4 of the flow valve 230, thus completing the refrigeration cycle.

The system 200 may also include an optional backup heat source 270, also controlled by the controller 227. The backup heat source 270 may be conventional or novel, and may be powered by electricity, natural gas, or any other fuel.

Figure 3:
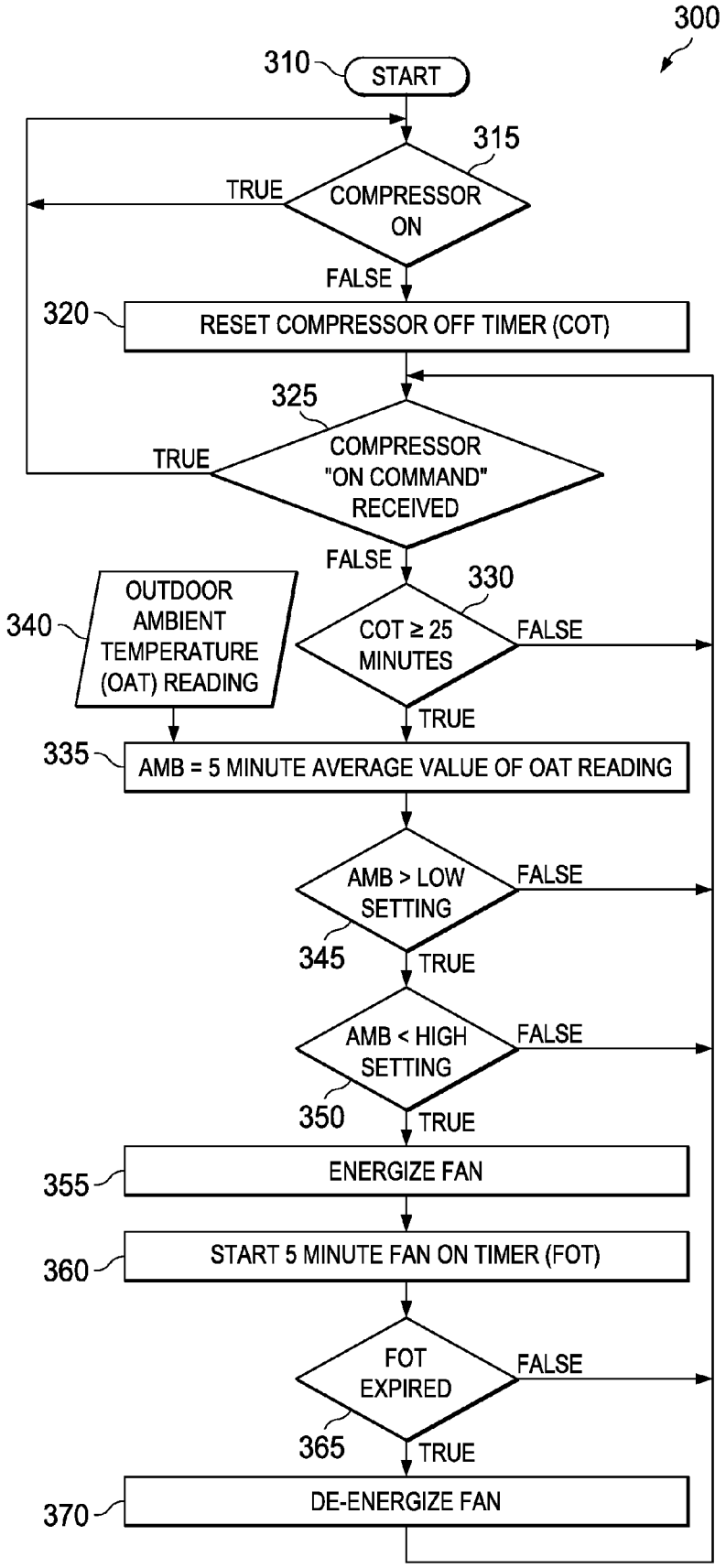
FIG. 3 is a flow diagram of a method of operating a fan motor of an air conditioning system according to one embodiment of the disclosure.

FIG. 3 presents a flow diagram of one embodiment of a method 300 of operating a controller configured to control a fan motor of the system 100 of FIG. 1 based upon the climate conditions proximate the exterior housing. This particular embodiment uses the controller to rotate the fan blades when a temperature reading proximate the exterior housing falls within a predetermined range. For example, the predetermined range wherein the fan blades are operated might be between about 35° F. and 15° F. It should be understood, however, that the temperature range set points may vary from one configuration to another, and can also be set locally or externally, whether wirelessly or not.

The method 300 begins with a start step 310. Thereafter, in a step 315, a decision is made whether the compressor, and thus motor coupled to the fan blades, are on. If the answer is true, then the method returns to step 315 until it is determined that the compressor is not on. As the compressor is on, and thus the motor is rotating the fan blades, the build up of ice and/or snow on the fan blades should be minimal. However, if the answer is false, the method advances to step 320, which is a step wherein a Compressor Off Timer (COT) is reset. The COT, in this embodiment, is a timer designed to keep track of the amount of time the compressor, and thus the motor rotating the fan blades, have been in an off state, and thus are in a position to accumulate ice and/or snow.

Thereafter, in a decisional step 325, a decision is made as to whether the compressor has received an "on command" since resetting the COT in step 320. If the answer is true that the compressor has received an "on command", the process would return to the decisional step 315. If the answer is false, and thus the compressor has not received the "on command", the process would move to decisional step 330. In the decisional step 330, it is determined whether the COT has reached a predetermined off period of time. In the process flow of FIG. 3, the predetermined off period of time is set at 25 minutes. In other embodiments, however, the predetermined off period of time might be set at a value ranging from about 20 minutes to about 30 minutes, among others. If the answer is false, the process returns to the decisional step 325. If the answer is true, the process moves to step 335 wherein an average outdoor ambient temperature (AMB) value is obtained. The AMB value, in the embodiment of FIG. 3, is a five minute average temperature value of the outdoor ambient temperature (OAT) reading obtained in the process step 340. Those skilled in the art understand that the amount of time upon which the temperature is averaged may vary, and the five minute average discussed above is but one example. Those skilled in the art further understand that process step 335 need not always be an average value, and in certain instances may be an instant value.

In a decisional step 345, it is determined whether the AMB value obtained in step 335 is greater than a low temperature set point value. If the answer is false (e.g., that the AMB value is below the low temperature set point value), the process returns to decisional step 325, as the temperature proximate the exterior housing to too cold for ice and/or snow to accumulate in an amount sufficient to damage the motor and fan blades. In an alternative embodiment, the process might return to decisional step 315. However, if the answer is true (e.g., that the AMB value is above the low temperature set point value), the process continues to decisional step 350. In decisional step 350, it is determined whether the AMB value obtained in step 335 is less than a high temperature set point value. If the answer is false (e.g., that the AMB value is above the high temperature set point value), the process returns to decisional step 325 (or decisional step 315 in another embodiment), as the temperature proximate the exterior housing to too warm for ice and/or snow to accumulate in an amount sufficient to damage the motor and fan blades. However, if the answer is true (e.g., that the AMB value is below the high temperature set point value), the process continues in a step 355. The step 355 consists of the controller sending a signal to the motor to begin rotating the fan blades as a result of the AMB value being between the high temperature set point value and the low temperature set point value.

As previously indicated, the various different values for the low temperature set point and high temperature set point may vary. For instance, in the embodiment of FIG. 3, the low temperature set point value is set at 15° F. and the high temperature set point value is set at 35° F. These two values were chosen for the current embodiment, as this range of temperature values limits the operation of the motor and fan to those conditions wherein ice and/or snow might be present. For instance, when the temperature is above about 35° F., any ice and/or snow will likely melt before negatively impacting the fan blades. Likewise, when the temperature is below about 15° F., the humidity level is generally low enough that ice and/or snow are unlikely to accumulate. Any operation of the motor and fan blades outside of this range would likely do nothing more than waste energy and place unnecessary wear and tear on the motor and fan blades. Notwithstanding, the particular set points for the temperature range may vary depending the desires of the user and the location of the unit, and may likewise be set and/or modified through a wired or wireless connection therewith. It should further be noted that in certain other embodiments, the low temperature set point is not used, and thus the motor and fan blades rotate at any temperature value below the high temperature set point value.

After process step 355, the fan on timer (FOT) is started in a step 360. The FOT, in the embodiment of FIG. 3, is set at 5 minutes. Nevertheless, other embodiments exist wherein the FOT is set between 2 minutes and ten minutes, among other settings. The process then moves to decisional step 65, wherein it is determined if the FOT has expired. If the answer is false, and the FOT has not expired, the process returns to decisional step 325. If the answer is true, and the FOT has expired, the process moves to step 370 wherein the fan is de-energized. Thereafter, the process would again return to decisional step 325 and the process would continue to repeat itself.

The process flow described with regard to FIG. 3 above may include many different variations. For instance, in one embodiment, the controller is configured to operate the motor, and thus fan blades, independent of the operation of the compressor. Thus, in this embodiment the motor and fans would be operating but the compressor would not. In another embodiment, the controller is configured to rotate the fan blades in a direction that is opposite to the direction that they might rotate if the compressor and motor were receiving an "on command". In yet another embodiment, the controller is configured to operate the motor at less than max speed. For example, the controller might signal the motor to run at 50% of its maximum speed, among other speeds. Other variations of the process flow described above also exist.

Figure 4:
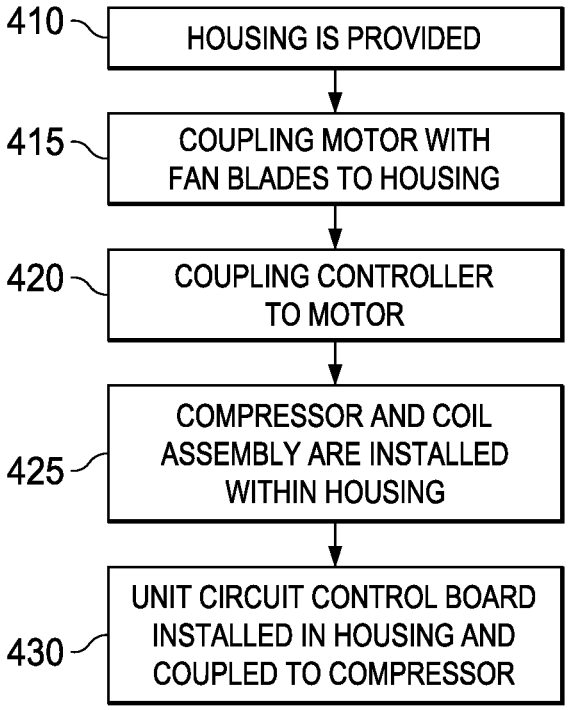
FIG. 4 illustrates a flow diagram of fabricating a portion of an air conditioning system in accordance with this disclosure.

Another aspect of this disclosure provides a method of manufacturing an air conditioning system, a flow diagram of which that is shown in FIG. 4. This method begins at step 410 in which an exterior housing is provided. As used herein, provided or providing includes those instances where the item is built by the assembling party or obtained from either an internal or external supplier. In step 415, a motor, which has fan blades attached to a rotary shaft extending from the motor, is placed within and attached to the housing. In step 420, a controller is coupled to the motor. Coupled refers to the controller being coupled to the motor by wires or being coupleable to the motor by a wireless system, and may be located on or within the motor housing itself or be located in a separate location from the motor. The controller is configured to rotate the fan blades based upon climate conditions proximate the exterior housing. In another step 425, the compressor and coil assembly are installed within the housing, and in step 430, control circuitry boards are attached to the housing and coupled to the compressor. It should be understood that these steps need not be accomplished in the order set out above and the assembling of the unit may include a number of other conventional steps required to complete the manufacture of the unit.

Those skilled in the art to which this application relates will appreciate that other and further additions, deletions, substitutions and modifications may be made to the described embodiments.

What is claimed is:

1. An air conditioning system, comprising:
an exterior housing;
a compressor having coils fluidly coupled thereto and located within the exterior housing;
a motor having fan blades rotatably coupled thereto and located within the exterior housing; and
a controller coupled to the motor and configured to alternate between an ON cycle during which the fan blades are rotated and an OFF cycle during which the fan blades are not rotated when a temperature reading proximate the exterior housing falls within a predetermined range, the controller configured to not rotate the fan blades when the temperature reading falls below the predetermined range, the controller and predetermined range configured to reduce ice or snow buildup on the fan blades.

2. The system recited in claim 1, wherein the predetermined range is between about 35° F. and about 15° F.

3. The system recited in claim 1, wherein the ON cycle ranges from two to about ten minutes in duration and the OFF cycle ranges from twenty to about thirty minutes in duration.

4. The system recited in claim 3, wherein the OFF cycle is at least twenty-five minutes in duration.

5. The system recited in claim 1, wherein the controller continues to alternate between the ON cycle and the OFF cycle until the temperature reading proximate the exterior housing moves outside of the predetermined range or when an ON command signal is received at the motor when predetermined climate conditions within a structure are met.

6. The system recited in claim 1, wherein the controller is configured to rotate the fan blades independent of an operation of the compressor.

7. The system recited in claim 6, wherein the compressor and coils form a portion of a heat pump unit, and wherein the controller is a first controller and the system further includes a second controller configured to produce an on command signal to the motor when predetermined climate conditions within a structure are met.

8. The system recited in claim 1, wherein the controller is configured to rotate the fan blades to dislodge ice or snow on the fan blades.

9. The air conditioning system recited in claim 1, wherein the temperature reading proximate the exterior housing is obtained from an internet source based upon a location of the air conditioning system.

10. A method for manufacturing an air conditioning system, comprising:
providing an exterior housing;
placing a compressor having coils fluidly coupled thereto and within the exterior housing;
placing a motor having fan blades rotatably coupled thereto within the exterior housing; and
coupling a controller to the motor, the controller configured to alternate between an ON cycle during which the fan blades are rotated and an OFF cycle during which the fan blades are not rotated when a temperature reading proximate the exterior housing falls within a predetermined range, the controller configured to not rotate the fan blades when the temperature reading is below the predetermined range, the controller and predetermined range configured to reduce ice or snow buildup on the fan blades.

11. The method recited in claim 10, further comprising providing an orifice ring within the exterior housing and about the motor and fan blades.

12. The method recited in claim 11, wherein the compressor and coils form a portion of a heat pump unit, and wherein the controller is a first controller, and further including providing a second controller configured to produce an on command signal to the motor and compressor when predetermined climate conditions within a structure are met.

13. The method recited in claim 10, wherein the predetermined range is between about 35° F. and about 15° F.

14. The method recited in claim 10, wherein the controller continues to alternate between the ON cycle and the OFF cycle until the temperature reading proximate the exterior housing moves outside of the predetermined range or when an ON command signal is received at the motor when predetermined climate conditions within a structure are met.

15. The method recited in claim 10, further including obtaining the temperature reading proximate the exterior housing from an internet source based upon a location of the air conditioning system.

16. An air conditioning system, comprising:
an outdoor unit, comprising:
an exterior housing;
a compressor having outdoor coils fluidly coupled thereto located within the exterior housing; and
a motor having fan blades rotatably coupled thereto located within the exterior housing, the motor and fan blades configured to alternate between an ON cycle during which the fan blades rotate independent of the compressor and an OFF cycle during which the fan blades do not rotate when a temperature reading proximate the exterior housing falls within a predetermined range and not rotate independent of the compressor when the temperature reading is below the predetermined range, the predetermined range configured to reduce ice or snow buildup on the fan blades; and an indoor unit comprising:

an interior housing;

indoor coils fluidly coupleable to the outdoor coils and located within the interior housing; and a blower configured to move indoor ambient air over the indoor coils.

17. The air conditioning system recited in claim 16, wherein a controller coupled to the motor operates the fan blades independent of the compressor.

18. The air conditioning system recited in claim 16, wherein the temperature reading proximate the exterior housing is obtained from an internet source based upon a location of the air conditioning system.

* * * * *